US006251494B1

(12) United States Patent
Schreiber

(10) Patent No.: US 6,251,494 B1
(45) Date of Patent: Jun. 26, 2001

(54) HONEYCOMB STRUCTURE SEAL FOR A GAS TURBINE AND METHOD OF MAKING SAME

(75) Inventor: Karl Schreiber, Mellensee (DE)

(73) Assignee: Rolls-Royce Deutschland Ltd & Co KG, Oberursel (DE)

( * ) Notice: Subject to any disclaimer, the term of this patent is extended or adjusted under 35 U.S.C. 154(b) by 0 days.

(21) Appl. No.: 09/327,626

(22) Filed: Jun. 8, 1999

(30) Foreign Application Priority Data

Jun. 24, 1998 (DE) ..... 198 28 065

(51) Int. Cl.[7] ..... F01D 11/12; B32B 3/12

(52) U.S. Cl. ..... 428/116; 29/888.3; 228/181; 277/414; 277/415; 277/913; 415/170.1; 415/173.1

(58) Field of Search ..... 428/116, 118; 277/301, 409, 411, 412, 414, 415, 913; 415/170.1, 173.1; 228/181; 29/888.3

(56) References Cited

U.S. PATENT DOCUMENTS

| | | | | |
|---|---|---|---|---|
| 3,001,274 | * | 9/1961 | Price et al. | 228/181 |
| 3,067,507 | * | 12/1962 | Titus | 228/194 |
| 3,071,853 | * | 1/1963 | Price et al. | 228/181 |
| 3,633,267 | * | 1/1972 | Deminet | 228/181 |
| 3,846,903 | * | 11/1974 | Rupert et al. | 228/200 |
| 3,981,429 | * | 9/1976 | Parker | 228/194 |
| 4,013,210 | * | 3/1977 | Deminet | 228/106 |
| 4,937,125 | * | 6/1990 | Sanmartin et al. | 428/116 |
| 5,281,089 | * | 1/1994 | Brown et al. | 415/173.1 |

FOREIGN PATENT DOCUMENTS

| | | |
|---|---|---|
| 3235745C2 | 4/1983 | (DE) . |
| 0626502A1 | 11/1994 | (EP) . |
| 11-280199 * | 10/1999 | (JP) . |

OTHER PUBLICATIONS

German Patent Office Action, Nov. 3, 1998.

* cited by examiner

*Primary Examiner*—Francis J. Lorin
(74) *Attorney, Agent, or Firm*—Evenson, McKeown, Edwards & Lenahan, P.L.L.C.

(57) ABSTRACT

A honeycomb structure seal is provided for the casing of a turbine, particularly a gas turbine, having a base plate facing the casing wall as well as a brush-against section facing the tips of the turbine rotor blades. The seal includes a multi-layered construction such that the base plate is adjoined by an air-evacuated honeycomb structure section which is therefore insulating in partial areas by a vacuum and which is covered by an intermediate plate, on whose side facing away from the honeycomb structure section the brush-against section is arranged. The intermediate plate is soldered to the honeycomb structure section under vacuum conditions. The brush-against section can also be constructed as a honeycomb seal, in which case the honeycomb cells of the honeycomb structure section have a significantly larger partial surface than the honeycomb cells of the brush-against section.

20 Claims, 1 Drawing Sheet

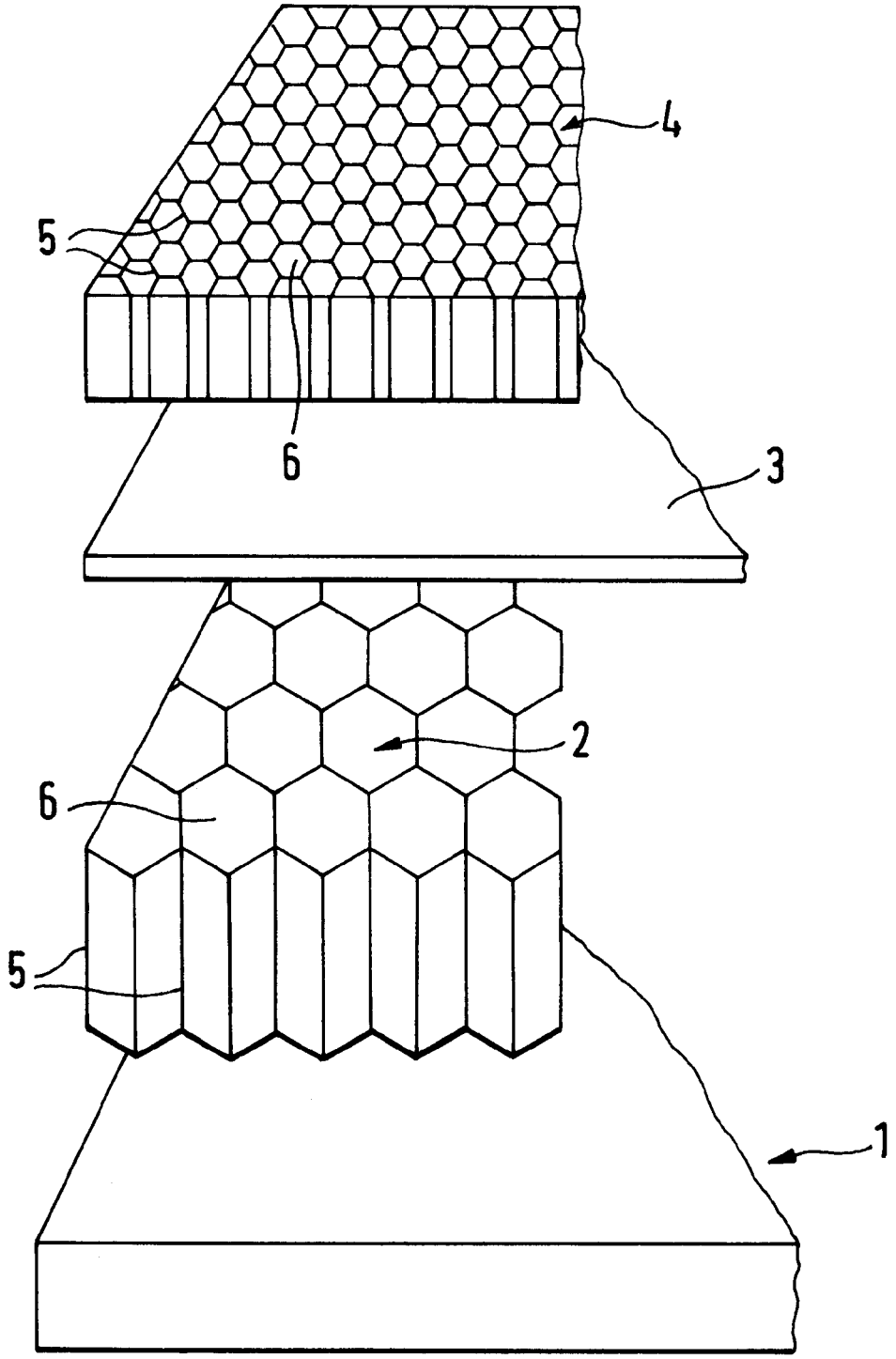
4
5
6
3
2
6
5
1

HONEYCOMB STRUCTURE SEAL FOR A GAS TURBINE AND METHOD OF MAKING SAME

BACKGROUND AND SUMMARY OF THE INVENTION

This application claims the priority of German application 198 28 065.3, filed Jun. 24, 1998, the disclosure of which is expressly incorporated by reference herein.

The invention relates to a honeycomb structure seal between a rotating element and a stator element of a turbine, particularly for a gas turbine, having a brush-against section facing the tips of the turbine blades as well as having a base plate facing the other element of the turbine. In particular, the above-mentioned turbine blades may be rotor blades so that the base plate faces the casing wall (=stator element) of the turbine. However, as an alternative, the base plate may also face the rotating turbine shaft so that the above-mentioned brush-against section faces the tips of the turbine stator blades. With respect to the technical environment, reference is made to German Patent Document DE 32 35 745 A1, as an example. In addition, it is explicitly pointed out that the term of the "honeycomb structure" is to be understood in a general sense; that is, it must not necessarily be the honeycomb structure associated with bees familiar to the person skilled in the art. On the contrary, it may be any arrangement of mutually adjacent hollow spaces of any geometry.

Brush-against seals for the rotor blades, for example, of gas turbines, which are arranged on the interior wall of the turbine casing, are, among other designs, also constructed as honeycomb seals. In this case, the honeycomb structure is carried by a base plate, while the web-type walls forming the honeycomb structure face the tips of the rotor blades by means of their free end sections. The honeycomb cells bounded by the web-type walls can be filled at least partially with a suitable insulation material, as described in the above-mentioned document.

Brush-against seals of gas turbines must fulfill two main tasks; specifically, (i) keeping the working gas as effectively as possible from flowing around the rotor blade tips, and (ii) furthermore insulating the turbine case at least in sections with respect to the hot working gas. This thermal insulation effect is to be such that the thermal casing expansion takes place simultaneously with the thermal and the superimposed centrifugal-force-induced expansion of the rotor disk and of the rotor blades in order to minimize the gap measurement between the blade tips and the turbine casing also during transient operating conditions (for example, during the warm-up phase) of the turbine. A minimizing of the gap measurement over the whole working cycle of a gas turbine, particularly of a flight gas turbine, is necessary because any enlargement of the gap measurement causes a reduction of the degree of thrust and efficiency.

These above-described requirements are at least partially met only insufficiently by means of the existing solutions of honeycomb structure seals. Either well-sealing fine-structured honeycomb structures cannot be filled sufficiently well with insulating material, or the coarser, easily fillable honeycomb structures do not have satisfactory sealing properties. As a result, the thermal insulation of the turbine casing is not sufficiently effective. Furthermore, combinations of metal and ceramics (if the honeycomb structure is conventionally metallic and the insulating material filled into the honeycombs is ceramic), particularly in the case of a thermocyclic stress, have a limited service life. Also, the ceramic fillers may cause damage to the inlet webs known to the person skilled in the art.

It is an object of the present invention to provide a remedial measure with respect to the above-described problems.

This object is achieved according to the invention by a multi-layered construction of the honeycomb structure seal such that the base plate is adjoined by an air-evacuated honeycomb structure section which is therefore insulating in partial areas by a vacuum and which is covered by an intermediate plate, on whose side facing away from the honeycomb structure section the brush-against section is arranged. Further developments and advantages of preferred embodiments are set forth below and in the claims. It should be pointed out again that the so-called honeycomb structure section is to be understood as an arrangement of several hollow spaces of essentially any shape side-by-side.

Other objects, advantages and novel features of the present invention will become apparent from the following detailed description of the invention when considered in conjunction with the accompanying drawings.

BRIEF DESCRIPTION OF THE DRAWINGS

The attached single drawing FIGURE is a perspective exploded view of a honeycomb seal constructed according to the invention.

DETAILED DESCRIPTION OF THE DRAWINGS

Reference number 1 indicates a base plate on whose surface a honeycomb structure is arranged which is customary in the case of honeycomb seals. In the following, this honeycomb structure adjacent to the base plate 1 will be called a honeycomb structure section 2 of the honeycomb structure seal according to the invention.

On the side opposite the base plate 1, the honeycomb structure section 2 is adjoined by an intermediate plate 3; that is, the honeycomb structure section 2 is covered by the intermediate plate 3. In this context, it should be pointed out again that the enclosed FIGURE is an exploded view; that is, in reality, the honeycomb structure section 2 is embedded directly between the base plate 1, on the one side, and the intermediate plate 3, on the other side.

A so-called brush-against section 4 is arranged on the intermediate plate 3, specifically on its side facing away from the honeycomb structure section 2. This brush-against section 4 rests again directly on the intermediate plate 3.

The illustrated honeycomb structure seal described so far is therefore distinguished by a multi-layer construction, consisting of the base plate 1, the honeycomb structure section 2, the intermediate plate 3 and the brush-against section 4. In the installed condition of this honeycomb structure seal in a turbine, particularly a flight gas turbine, the base plate 1 rests by means of its free (here, lower) surface against the interior wall of the turbine casing, which is not shown, while the free surface (which is on top in the FIGURE) of the brush-against section 4 faces the (also not illustrated) blade tips of the turbine rotor blades.

As a result, the brush-against section 4 is constructed with a view to the required sealing effect; that is, the sealing of the gap between the not shown blade tips and the honeycomb structure seal. This brush-against section 4, against which the blade tips can or should actually brush for achieving an optimal sealing effect may therefore be a brush seal, a plasma spray layer, a metal felt or a METCO-layer known to the person skilled in the art, or other suitable sealing structures. In the embodiment illustrated here, this brush-against section 4 itself is again constructed in the form of a honeycomb seal which is customary per se; that is, it consists as usual of a large number of web-type walls 5 which are, for example, preferably arranged in a honeycomb shape and which each form so-called honeycomb cells 6. In this case, no thermal sealing material is filled into the honeycomb cells 6 of this brush-against section 4 constructed as a honeycomb seal, because, as mentioned above, the function of this brush-against section 4 is only to seal off as well as possible the gap between the blade tips of the turbine rotor and the whole honeycomb structure seal against a flowing-through of working gas.

The—as explained at the beginning—additionally required second thermal sealing function of the honeycomb structure seal according to the invention, in contrast, is taken over by the honeycomb structure section 2. For this purpose, the latter is air-evacuated; that is, a thermal insulation caused by a vacuum exists in the partial areas of the individual honeycomb cells 6 of the honeycomb structure section 2. So that the vacuum is maintained which exists at least essentially in the honeycomb cells 6, it is naturally necessary that the honeycomb cells (in the figures, toward the top and toward the bottom) are closed off, which is ensured by the base plate 1, on the one hand, and by the intermediate plate 3, on the other hand.

At least the section of the honeycomb structure seal which is formed by the honeycomb structure section 2 as well as the base plate 1 and the intermediate plate 3 can be produced by means of high-temperature soldering under vacuum conditions. This means that the intermediate plate 3 is soldered in the vacuum (to the extent that it is technically achievable; an absolute vacuum is naturally not possible) onto the honeycomb structure section 2 which had already been appropriately connected with the base plate 1. In the same manufacturing process, the brush-against section 4 can simultaneously be connected with the intermediate plate 3.

The honeycomb structure seal suggested here therefore consists of two honeycomb structures connected with one another by means of an intermediate plate 3, specifically the honeycomb structure section 2 and the brush-against section 4. These two honeycomb sections may be commercially available and preferably consist of thin metallic high-temperature alloys. The (here, lower) honeycomb structure section 2 takes over the function of the thermal insulation. By a variation of the size and height of the structure, it can therefore be constructively adapted to the required insulation characteristics. Since the desired thermal insulation effect is achieved by the vacuum existing (at least essentially) in the honeycomb cells 6, these honeycomb cells 6 should preferably have a base or cross-sectional surface which is as large as possible.

In contrast, the here, upper sealing honeycomb structure, that is, the brush-against section 4, is adapted in its construction to the requirements of the sealing effect with respect to the turbine working gas which sweeps past it. In the case of a construction as a honeycomb structure, as known, the achievable sealing effect will be the better, the smaller the base surfaces or cross-sectional surfaces of the honeycomb cells 6 of this honeycomb structure. As demonstrated, it is therefore provided that the honeycomb cells 5 of the brush-against section 4 constructed as a honeycomb seal have a significantly smaller partial surface than the honeycomb cells 6 of the honeycomb structure section 2.

On the whole, a desired heat insulation (and also heat conduction) can be achieved within wide limits on a honeycomb structure seal according to the invention by the variation of the (here, lower) air-evacuated honeycomb structure section 2 with respect to the structure size, structure height and web thickness. Because of the smaller (here, upper) honeycomb structure as the brush-against section 4, which therefore hinders a passing working gas flow better and therefore has a better sealing effect, the flow around the (not shown) blade tips which face this brush-against section 4 is reduced. Since the thermal insulation is taken over by the honeycomb structure section 2, which is on the bottom here, a filling of the (here, upper) honeycomb cells 6 of the brush-against section 4 is not required but optionally possible.

Finally, it should be pointed out again that the vacuum-insulated honeycomb structure section 2, as an alternative, can also be used as an insulating substructure for a different brush-against section 4 than the one shown. This means that for this brush-against section 4, other seal systems can also be used, such as a brush seal, METCO layers, plasma spray layers, metal felts or the like, which can each be applied to the described vacuum-type insulating structure. Naturally, a larger number of additional details, particularly of a constructive type, can be designed to deviate from the illustrated embodiment, without leaving the content of the claims.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Honeycomb structure seal operable in use between a rotating element and a stator element of a turbine, particularly for a gas turbine, comprising:

a brush-against section which in use faces tips of turbine blades, and a base plate facing another turbine element, wherein a multi-layered construction is provided such that the base plate is adjoined by an air-evacuated honeycomb structure section which is therefore insulating in partial areas by a vacuum and which is covered by an intermediate plate, the brush-against section being arranged facing away from the intermediate plate.

2. Honeycomb structure seal according to claim 1, wherein the intermediate plate is soldered to the honeycomb structure section under vacuum conditions.

3. Honeycomb structure seal according to claim 1, wherein the brush-against section is constructed as a honeycomb seal.

4. Honeycomb structure seal according to claim 2, wherein the brush-against section is constructed as a honeycomb seal.

5. Honeycomb structure seal according to claim 3, wherein honeycomb cells of the brush-against section constructed as the honeycomb seal have a significantly smaller partial surface than honeycomb cells of the air evacuated honeycomb structure section.

6. Honeycomb structure seal according to claim 4, wherein honeycomb cells of the brush-against section constructed as the honeycomb seal have a significantly smaller partial surface than honeycomb cells of the air evacuated honeycomb structure section.

7. A multi-layered seal operable in use between a rotor element and a stator element comprising:

a base plate, an air evacuated honeycomb structure layer fixed to the base plate, an intermediate plate fixed to the air evacuated honeycomb structure layer at a side thereof opposite the base plate, and a brush against section fixed to the intermediate plate at a side facing away from the base plate, said brush against section being operable in use to brush against adjacent facing structure.

8. A multi-layered seal according to claim 7, comprising a solder connection between the base plate and the air evacuated honeycomb structure.

9. A multi-layered seal according to claim 7, wherein the brush-against section is constructed as a honeycomb seal.

10. A multi-layered seal according to claim 9, wherein honeycomb cells of the brush-against section constructed as the honeycomb seal have a significantly smaller partial surface than honeycomb cells of the air evacuated honeycomb structure section.

11. A multi-layered seal according to claim 9, comprising a solder connection between the base plate and the air evacuated honeycomb structure.

12. A multi-layered seal according to claim 10, comprising in a solder connection between the base plate and the air evacuated honeycomb structure.

13. A method of making a multi-layered seal operable in use between a rotor element and a stator element comprising:

providing a base plate, fixing an air evacuated honeycomb structure layer to the base plate, fixing an intermediate plate to the air evacuated honeycomb structure layer at a side thereof opposite the base plate, and fixing a brush against section to the intermediate plate at a side facing away from the base plate, said brush against section being operable in use to brush against adjacent facing structure.

14. A method according to claim 13, wherein said fixing of said air evacuated honeycomb structure layer to the base plate includes soldering parts together under vacuum conditions.

15. A method according to claim 13, wherein said fixing of the intermediate plate to said air evacuated honeycomb structure layer includes soldering parts together under vacuum conditions.

16. A method according to claim 13, wherein the brush-against section is constructed as a honeycomb seal.

17. A method according to claim 16, wherein honeycomb cells of the brush-against section constructed as the honeycomb seal have a significantly smaller partial surface than honeycomb cells of the air evacuated honeycomb structure layer.

18. A method according to claim 14, wherein said fixing of the intermediate plate to said air evacuated honeycomb structure layer includes soldering parts together under vacuum conditions.

19. A method according to claim 18, wherein the brush-against section is constructed as a honeycomb seal.

20. A method according to claim 19, wherein honeycomb cells of the brush-against section constructed as the honeycomb seal have a significantly smaller partial surface than honeycomb cells of the air evacuated honeycomb structure layer.

* * * * *